United States Patent [19]

Conner

[11] 4,095,785

[45] Jun. 20, 1978

[54] MANUALLY INDEXED ELECTRONIC MATCHING GAME

[76] Inventor: Gary L. Conner, 16820 White Creek Rd., Sand Lake, Mich. 49343

[21] Appl. No.: 760,650

[22] Filed: Jan. 19, 1977

[51] Int. Cl.[2] ..... A63B 71/04

[52] U.S. Cl. ..... 273/1 E

[58] Field of Search ..... 35/8 R, 9 A, 6, 22 R; 273/1 E, 130 AB, 131 A, 135 A, 136 A, 138 A, 143 R, 134 A; 235/92 G, 92 A; 340/323 R

[56] References Cited

U.S. PATENT DOCUMENTS

| | | | |
|---|---|---|---|
| 1,857,629 | 5/1932 | Epstein et al. | 273/1 E |
| 2,491,888 | 12/1949 | Baker | 273/1 E |
| 2,984,017 | 5/1961 | Pask | 35/8 R |
| 3,770,269 | 11/1973 | Elder | 273/138 A X |
| 3,869,812 | 3/1975 | Arakelian | 35/22 R |
| 3,918,176 | 11/1975 | Abernethy et al. | 35/22 R |
| 4,017,081 | 4/1977 | Windisch | 273/138 A |

*Primary Examiner*—Richard C. Pinkham

*Assistant Examiner*—Vance Y. Hum

*Attorney, Agent, or Firm*—Price, Heneveld, Huizenga & Cooper

[57] ABSTRACT

An electronic game includes an array of three rows of indicators, one row of which is sequentially actuated by a scanning circuit. The second row aligned with the first row provides indicators actuated each time an indicator of the first row has been matched by an aligned one of a third row of aligned indicators in turn sequentially actuated for a predetermined period of time in response to the player actuation of a push button switch. The game includes an adjustment for varying the scanning rate of the first row of indicators and for providing a predetermined period of time in which the player has to win the game by matching each of the scanned indicators with the simultaneous actuation of an aligned indicator of the third row. In one embodiment, the matching of the scanned indicators can be done randomly, while in an alternative embodiment, they must be matched sequentially.

19 Claims, 3 Drawing Figures

MANUALLY INDEXED ELECTRONIC MATCHING GAME

BACKGROUND OF THE DISCLOSURE

The present invention relates to electronic games and, in particular, to a game requiring the matching of a scanning row of indicators by player reaction in selectively actuating one of an aligned row of indicators simultaneously with an actuated scanned indicator.

There exists a variety of games or teaching machines which involve operator interraction with lights including matching of randomly actuated light sequences. Representative of such prior art are: U.S. Pat. Nos. 2,984,017 Pask; 3,918,176 Abernethy, III et al.; 2,491,888 Baker; 3,869,812 Arakelian et al.; 1,857,629 Epstein et al.; and 3,531,114 Parks et al. These systems typically are used for testing purposes or for rehabilitation. Also none of the prior art discloses the concept of providing a sequentially scanned row of indicating means which must be randomly or sequentially matched by the operator in order to win the game.

SUMMARY OF THE PRESENT INVENTION

The present invention provides an improved electronic game in which scanning means provide first signals for sequentially actuating a row of indicating means and sequencing means provide a player generated signal in response to a player actuated switch the system includes coincidence detecting means for determining that the player generated signal is in time coincidence with the actuation of one of the row of scanned indicators. In the event that one of the player generated signals occurs in time coincidence with the scanning indicator signal, a third signal is developed which provides an output signal for actuating a display indicating that a successful match has been accomplished. The means for developing generated signal advances to the next position each time the player actuates the switch. The game is won by matching each of the scanned indicator positions within a predetermined, selectable game time.

In one embodiment display means are provided in an array of three rows of vertically aligned indicators such as light emitting diodes. One row of the diodes are coupled to the scanning means to sequentially scan. Another row of diodes are coupled to the sequencing means to be sequentially actuated by the player in response to actuation of a push button switch. The final row of diodes are coupled to the coincidence detecting means for providing an indication to the player when a match between diodes of the scanning row and the player actuated diodes has occurred.

The many features and advantages of the present invention and its alternative embodiments can best be understood by referring to the following description thereof together with the drawings, in which:

DETAILED DESCRIPTION OF THE PREFERRED EMBODIMENT

Figure 1:
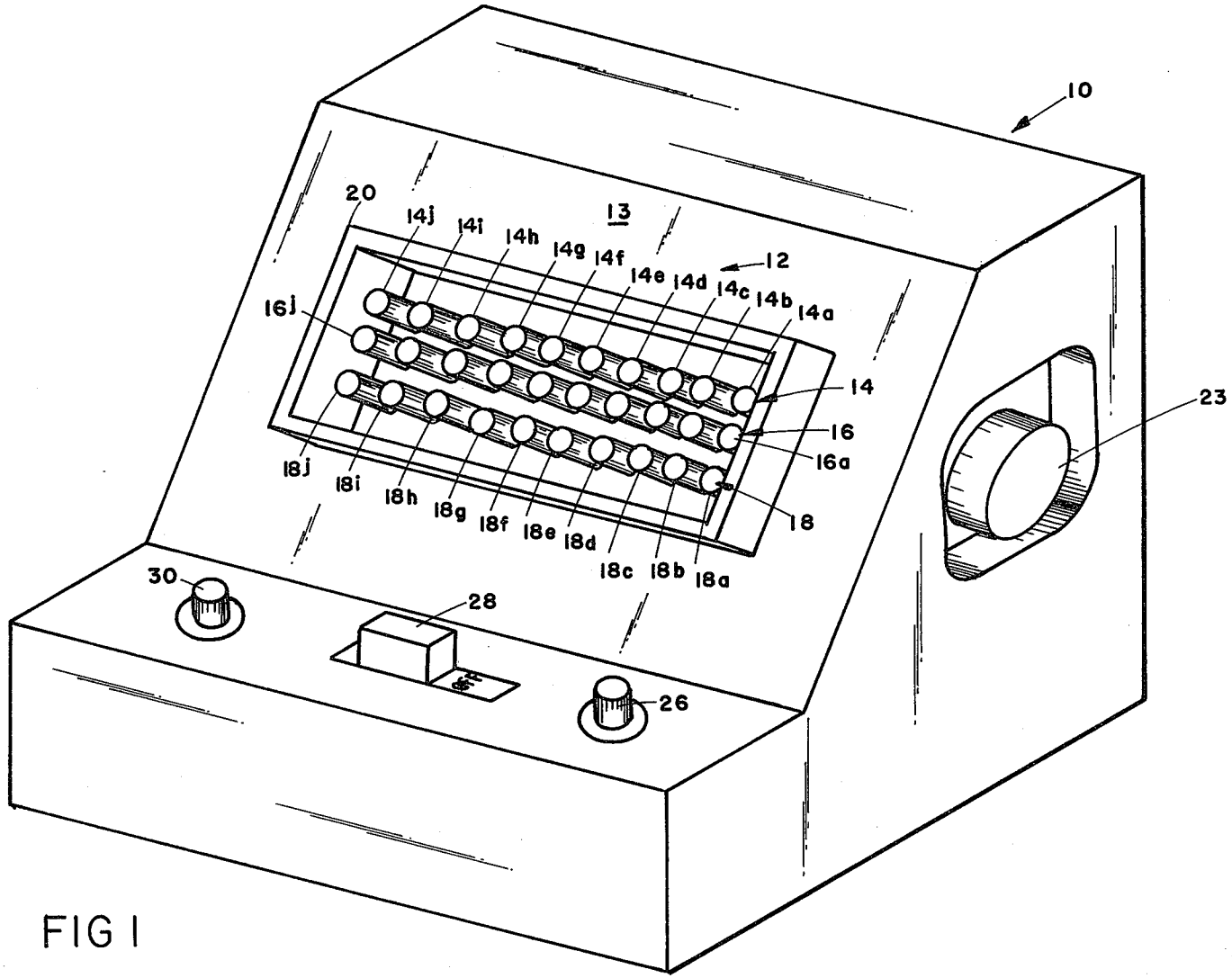
FIG. 1 is a perspective view of one embodiment of the present invention.

Referring initially to FIG. 1 there is shown an electronic game including a housing 10 with a display panel 12 set in an inclined surface 13 of the housing. The display comprises a first row 14 of indicator means which in the preferred embodiment were 10 equally spaced light emitting diodes (LEDs) were **14*a*–14*j*. A second row 16 of LEDs 16*a*–16*j* are aligned below the first row 14 and a third row 18 of LEDs 18*a*–18*j*** are similarly positioned in alignment below the second row. Indicating means other than LEDs may be used and the display can be arranged in vertical columns or other series of indicating means other than the rows shown.

Surrounding the display matrix of LEDs in a rectangular molding 20 increasing the visibility of the lights under high ambient light conditions by providing a shadowbox effect.

At one end of the housing there is a control knob 23 associated with an adjustable resistor 22 (FIG. 2) for varying the scanning rate of the uppermost row 14 of the indicators. The system similarly includes a second adjustable resistor 24 (FIG. 2) which includes an adjustment knob mounted to the wall of the housing opposite knob 22, and not shown in FIG. 1. The second resistor 24 can be adjusted to vary the time during which the player has to attempt to successfully match the scanning row of indicator lights 14 with the sequencing row of lights 18, individually and sequentially illuminated in response to actuation of a push button switch 26 mounted on the housing as shown in FIG. 1. The game includes a power on-off switch 28 for providing electrical power to the enclosed circuitry. A game reset button 30 is also provided for resetting the circuitry to enable the player to again match his skills against the game.

Briefly, the game operates by sequentially actuating each of the 10 scanning LEDs in the first row 14 for a predetermined, relatively short period of time. The time for each scan of row 14 is adjustable generally from a fast rate of two complete scans per second to a rate of two seconds per scan. As the player depresses push button switch 26 once, one of the LEDs of row 18 will be actuated. The successive actuation of the push button switch 26 causes the next adjacent LED to be illuminated. The object of the game is to actuate push button switch 26 such that the LED in row 18 aligned directly below the LED in scanning row 14 is illuminated at the same time. If this is accomplished, this coincidence in illumination of the LEDs is detected and one of the matching LEDs in row 16 is illuminated either continuously or in a flashing manner indicating to the player that one of the ten matches has been successfully accomplished. To win the game the player must match each of the ten positions by actuation of the push button switch 26 within the predetermined game time or match more than another player. The game time can be varied to a maximum of fifty seconds. By also varying the scanning rate of row 14, the degree of difficulty of the game can be significantly increased.

In place of the display panel 12 integrally included within the cabinet or housing 10, the system can employ a remote display such as the kinescope of a television receiver in which case a video signal generator coupled to the circuit by a suitable connector is required to provide the display format. The circuit employed for actuating either the display 12 shown in the preferred embodiment of FIG. 1 or any other type of remote display, however, is identical and is shown in detail in FIG. 2.

Figure 2:
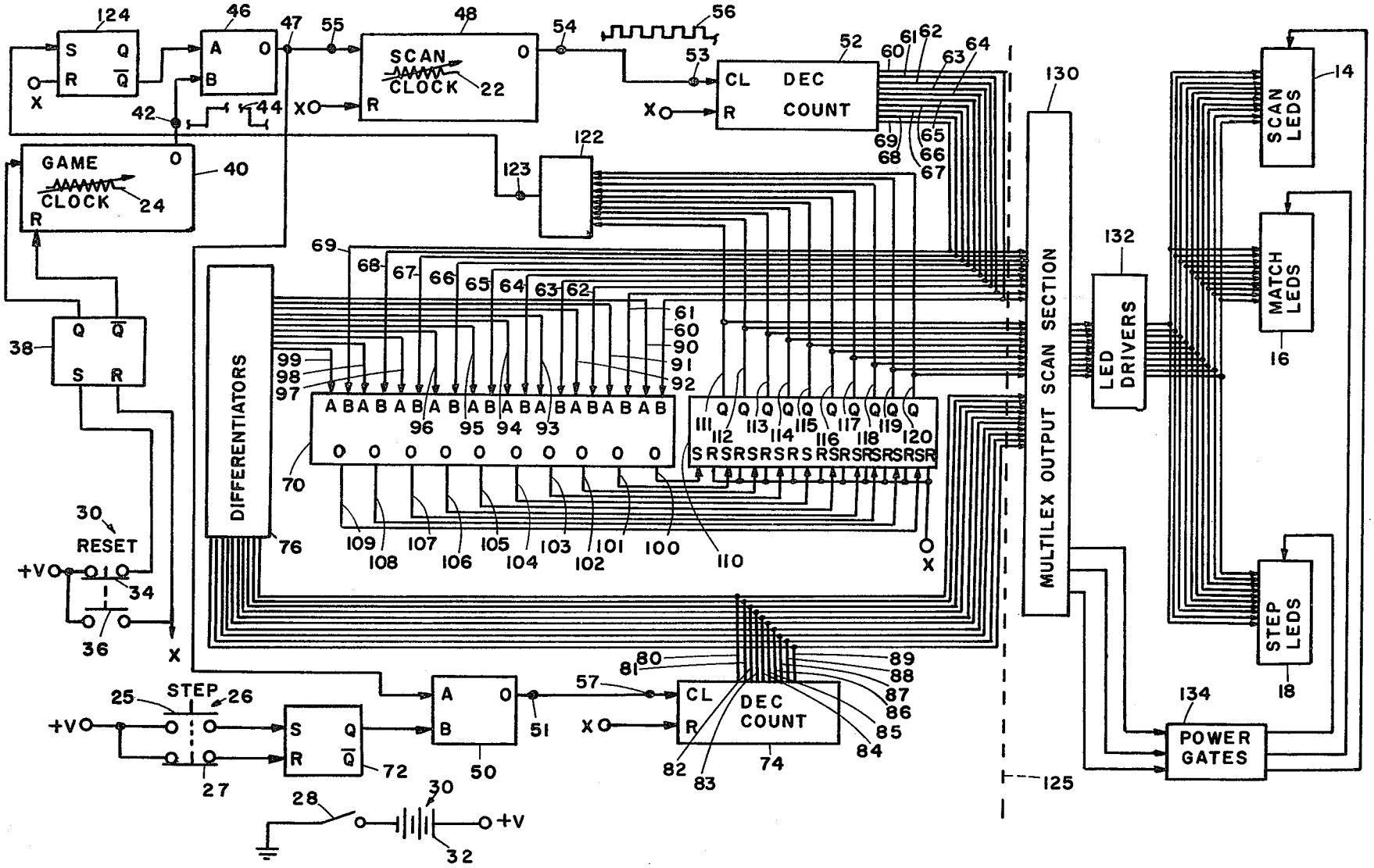
FIG. 2 is an electrical circuit diagram partly in schematic and block form of the embodiment shown in FIG. 1.

Referring now to FIG. 2 there is shown a +V power supply 30 comprising a 9-volt battery 32 having its negative terminal coupled to ground through the on-off power switch 28 and its positive output terminal designated +V for supplying operating power to the various solid state circuits shown in block form in the Figure. Each of the circuits are coupled to +V as well as to the system ground in a conventional manner, not shown.

In order to initiate a game, the spring loaded push buttton reset switch 30 is actuated. This switch includes a pair of contacts, the first contact 34 being normally closed and the second contact 36 being normally open. The input sides of these contacts are commonly coupled to +V to provide a logic '1' output signal from the switch contacts when closed or a logic '0' when open. The contacts 34 and 36 are also to the set and reset inputs respectively of a flip-flop circuit 38. The Q and $\overline{Q}$ outputs of flip-flop 38, respectively, are coupled to enabling inputs of a game clock 40. Clock 40 comprises a conventional, commercially available National Semiconductor LM555 timer chip.

Actuation of switch 30 momentarily causes the Q and $\overline{Q}$ outputs to reverse state and upon return to the normal '1' and '0' states respectively, the game clock 40 is enabled and provides an output pulse 44 at the output terminal of the clock 40, the leading edge of pulse 44 determines the starting time for the game and the trailing edge of pulse 44 determines the end of game period. By adjusting resistor 24, the game time and thus the width of pulse 44 can be adjusted from approximately ten to fifty seconds as desired. Pulse 44 is applied to input B of a two input AND gate 46 which normally has a logic '1' applied to input terminal A thereby actuating gate 46 to provide a logic output '1' defining an enabling signal at output terminal 47. Terminal 47 is coupled to the input 55 of a scan clock 48. Output terminal 47 is also coupled to input terminal A of AND gate 50 for enabling the AND gate 50 as will be described more fully hereinafter.

The output terminal of switch contact 36 is designated as X and is intercoupled to the remaining terminals so designated and provides a reset pulse for sychronizing the system. A decade counter 52 has an input terminal 53 coupled to the output terminal 54 of the scan clock 48. Clock 48 responds to the enable signal from terminal 47 and to the reset pulse applied to terminal X to provide at output terminal 54 a series of pulses 56, the frequency of which is determined by the adjustment of resistor 22. As with clock 40, the scan clock comprises a commerically available 555 timer operating in a free-running, variable frequency mode. Decade counter 52 responds to pulses 56 to provide sequential output pulses to its ten output conductors 60–69 in a stepwise fashion. Thus, for example, conductor 60 will be actuated during the period the first pulse from clock 48 is received. Upon receipt of the second clock pulse by a counter 52, line 60 will be deactuated and line 61 will be the only output conductor actuated. Similarly, upon receipt of ten successive pulses, the decade counter will successively actuate the ten output conductors 60–69 automatically repeating the sequential scanning of the outputs after ten such pulses have been received. Thus output conductors 60–69 are repetitively actuated from a logic '0' to a logic '1' state at a frequency determined by the setting of resistor 22. These output conductors are applied to the input terminals B of an integrated circuit chip 70 comprising ten separate two input AND gates. As will be described more fully hereinafter, conductors 60–69 also are applied to a multiplex circuit 130 for sequentially actuating the first row 14 of scanning LEDs in the display 12.

In order for the player to match one of the momentarily illuminated scanning LEDs 14*a*–14*j*, sequentially actuated by the circuitry above described, the two contact, spring-loaded push button stepping switch 26 is provided. Switch 26 includes normally open contacts 25 and normally closed contacts 27. When actuated the output of these switch contacts having a common input terminal coupled to +V are applied to the S and R input terminals, respectively, of a flip-flop circuit 72. The Q output terminal of circuit 72 is coupled to the input terminal B of AND gate 50. Terminal A of AND gate 50 is coupled to terminal 47 as previously described to receive a logic '1' enabling signal during the game period determined by the width of pulse 44. Thus during the game, AND gate 50 will provide a logic '1' output signal from its output terminal 51 whenever the step or sequencing switch 26 is actuated by the player.

The output terminal 51 of gate 50 is coupled to the clock input terminal 57 of a second decade counter 74 also having a reset input terminal X coupled to the reset switch 30. Decade counter 74 includes ten output terminals 80–89 which are sequentially actuated upon receipt of successive pulses from gate 50 in response to the successive operation of switch 26 by the player. Thus, for example, during a game start up output conductor 80 will be actuated upon application of power and the reset switch and will remain at a logic '1' state until switch 26 is actuated by the player. Upon actuation of the switch 26 during the game, conductor 80 will be deactuated and only conductor 81 actuated. Similarly as the switch is successively pushed successive conductors 82–89 are activated repeating the sequence after conductor 89.

Conductors 80–89 are coupled to a differentiator circuit 76 constituting ten separate conventional RF differentiators having a time constant of approximately 1 millisecond. Circuit 76 provides output pulses in response to the steady state input signals applied from counter 74 to output conductors 90–99 which are directly coupled to input terminals A of the ten AND gates 70. As noted above, the remaining input terminals of each of the AND gate inputs 70 are actuated by the output from counter 52. When the player actuates step switch 26 at substantially the same instant of time that one of the corresponding inputs to gate 70 is actuated from the scanning clock 48, the particular AND gate will be actuated to provide at one of its 10 outputs 100–109 a logic '1' signal applied to a corresponding "set" input terminal of a integrated circuit chip comprising ten flip-flops 110.

The output terminals 80–89 of the decade counter 74 also are coupled to circuit 130 for actuating LEDs 18*a*–18*j* of display 12 as more fully described hereinafter to provide a visual indication of which of the LEDs will next be actuated by switch 26 to permit an attempted match of the aligned scanning LED by the player.

Thus as a player successively matches a scanning display indicia with the corresponding match indicia by actuating switch 26, successive coincidence pulses will be detected by gate 70 to actuate latch circuit 110 thereby providing a continuous output signal on its output conductors 111–120. Conductors 111–120 are coupled to circuit 130.

Conductors 111 and 120 are also coupled to a 10 input AND gate 122 having its output terminal 123 coupled to the set input of flip-flop 124. Receipt of the signal from output terminal 123 of the AND gate by flip-flop 124 provides a logic '0' output on its $\overline{Q}$ output terminal to disable AND gate 46 thereby terminating the game time pulse 44 and stopping the scanning clock 48. Thus should the player successfully match each of the scanning indicia prior to the expiration of the game clock, the scanning will automatically be terminated and all of the indicator LEDs in row 16 are lighted continuously. As will be explained more fully hereinafter, the output signal from gate 122 can also be employed for a variety of other control function.

Thus it is seen that the scanning sequencing and coincidence detecting circuitry of FIG. 2 provides thirty lines of output signals 60–69, 80–89 and 111–120. These output signals correspond to the indicator rows 14, 18 and 16, respectively, of the display LEDs of the preferred embodiment. In order to save power, instead of continuously actuating the LEDs during the period of time one of the thirty output lines is actuated, a multiplex output scan section circuit 130 is provided. If a display other than the LED display of the preferred embodiment is employed, circuit 130 and the various LED drivers will not be required. Thus the circuitry to the right of dashed line 125 shown in FIG. 2 can be substituted by any desired display including a remmote video terminal with a matrix generator to provide the desired array of indicia for the game.

Circuit 130 represents a conventional flashing technique frequently applied to LED displays in order to save battery power. Basically the concept is to flash the LEDs at a rate which is imperceptable to the human eye such that the player perceives a continuous LED actuation during the period of actuation but the power required is significantly reduced. This is achieved by including in circuit 130 a clock and a decade counter for providing periodic output pulses which are applied to one input of each of a series of AND gates having the input signal information from conductors 60–69, 80–89 and 111–120 applied to their remaining input terminals. This pulses the LED driver circuit 132 to provide an enable signal to one power terminal or position of each of the rows of LEDs. The remaining commonly coupled terminals of the LEDs are coupled to power gates 134 which likewise receive pulse driving signals from circuit 130 to permit actuation of the LEDs only upon the coincidence of the actuation of an associated LED by driver 132 and one of the common return lines to the row of LEDs 14, 16, or 18, respectively.

Thus is is seen that circuit 130 receives input information as to thirty different input terminals and provides a matrix of flashing output signals to ten terminals applied to LED drivers 132 and three terminals applied to power gates 134 to provide the 30 unique bits of information received from the input and applied to the array of LEDs. In such manner all of the information is transferred from the output of the scanning, sequencing and coincidence detecting circuits of FIG. 2 to the LED display circuit with a minimum power drain on battery 32.

Figure 3:
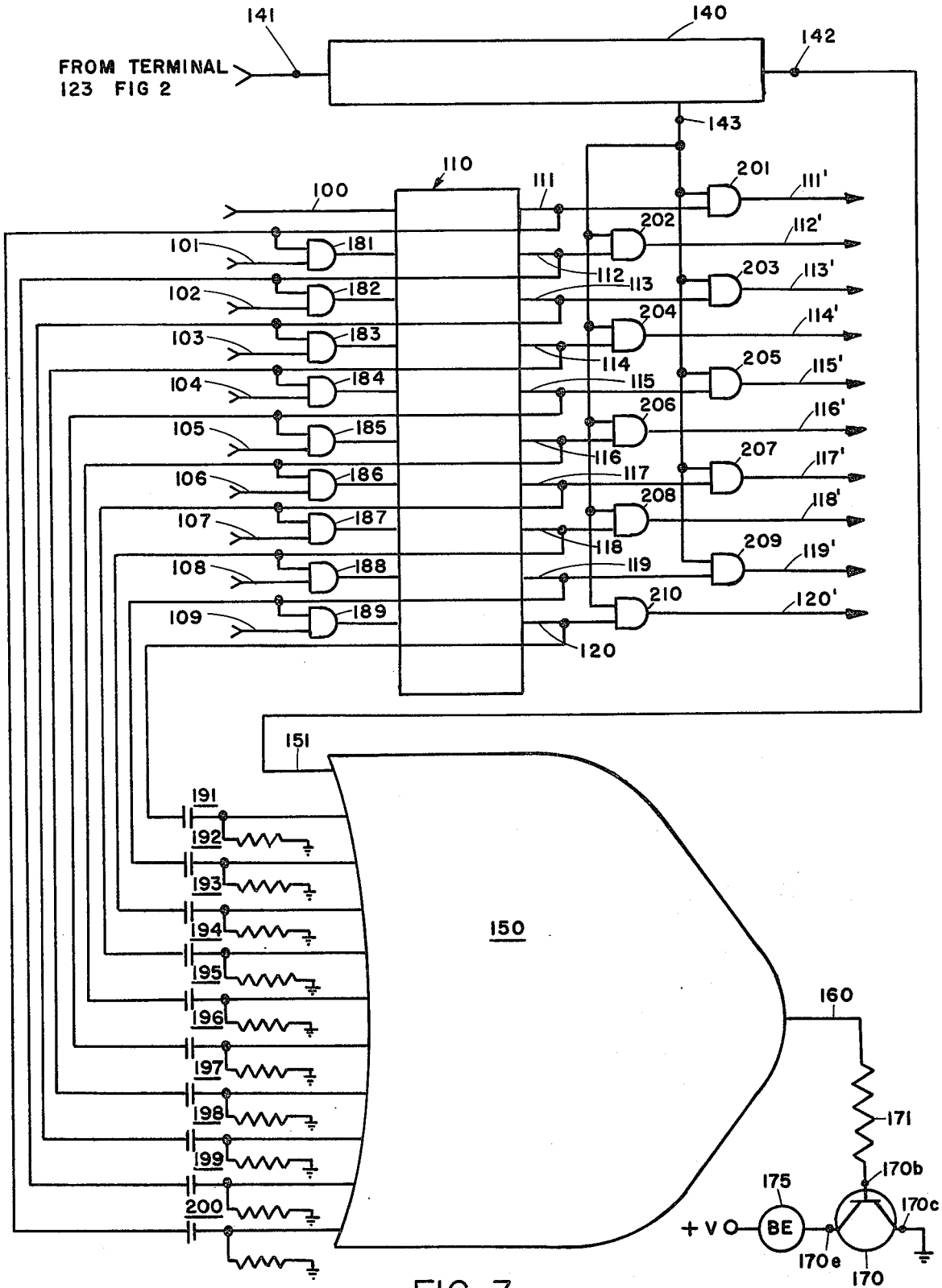
FIG. 3 is a modification to the circuitry shown in FIG. 2 providing an alternative embodiment of the invention.

The circuitry of FIG. 2 can be modified as shown in FIG. 3 to provide optional operation of the system. Thus, for example, in the FIG. 2 embodiment, the player can match any of the sequentially actuated scanning LEDs in row 14 in random fashion. Thus in the event, for example, LED **14*d* is matched by the player the next match could be any of the remaining LEDs. In order to make the game somewhat more difficult, it can be modified as shown in FIG. 3** to permit only sequential matching instead of random matching.

In the FIG. 3 circuit, the circuit elements and conductors identical to those in FIG. 2 are commonly identified with the same reference numerals. The circuit of FIG. 3 includes a timing generator 140 which is substantially similar to timer 40 and responds to an all matching signal from gate 122 applied to the input terminal 141 of circuit 140 to provide a pulse at output terminal 142 of approximately 1 to 2 seconds in duration. This pulse is in turn applied to input terminal 151 of an eleven input OR gate 150. Gate 150 responds to provide an output signal at terminal 160 applied to the base terminal **170*b* of NPN transistor 170 through current limiting resistor 171. Transistor 170 has its emitter terminal 170*e* coupled to the +V supply through a bell 175 and its collector terminal 170*c* grounded. Thus upon successfully matching each of the ten scanning indicators by the player, bell 175** will be momentarily actuated for from one to two seconds indicating that the game is won.

The timer circuit 140 also has an output terminal 143 providing continuous output pulses when the circuit 140 is supplied operating power regardless of the input on terminal 141. As will be described hereinafter, the pulses from output terminal 143 are employed for visibly flashing the matching LEDs in row 16 of the display 12 shown in FIG. 1 instead of providing a steady state signal.

In addition the circuitry of FIG. 3 provides sequential matching only by the utilization of a plurality of input AND gates 181–189 having one input terminal coupled to input conductors 101–109, respectively, from AND gate 70 shown in FIG. 2 and the remaining input terminals coupled to output terminals 111–120, respectively, of latch circuit 110. Thus it is readily seen that before any of the remaining matching indicators in display row 16 can be illuminated by actuation of output lines 112–120 of latch circuit 110, the first indicator must be actuated by a coincidence signal on input line 100. This signal which will provide a latched output on line 111 in turn will enable gate 181 permitting only the second indicator light to be actuated upon receipt of a coincidence signal on line 101.

Thus gates 182–189 will be successively enabled permitting only sequential actuation of the matched display lights by the sequential enabling outputs from conductors 111–120 from latch circuit 110. These output signals are also employed to provide a momentary ringing of bell 175 by coupling output conductors 111–120 to the remaining ten inputs of OR gate 150 through differentiator circuits 191–200.

The time constant of the RC differentiators 191–200 is selected to provide a momentary pulse of two to three millisecond duration through the inputs of OR gate 150 which respond thereto for momentarily actuating bell 175 each time the operator successfully matches the scanning light by pushing switch 26 (FIG. 2) at the correct moment of time. Naturally the bell ringing circuit can be employed independent of the sequential actuating gates 181 and 189 to provide the audio feedback to the player in addition to the actuation of the matching lights in the embodiment shown in FIG. 2.

An additional visual signal to the operator can be generated by means of additional AND gates 201–210 having one input terminal coupled to the pulse output terminal 143 of timer 140 and the remaining input terminals coupled to output conductors 111–120, respectively, of the latch circuit 110. By anding these outputs, there is provided latching output conductors 111'–120', respectively, which are coupled to the display circuit in the same configuration as lines 111–120 shown in FIG. 2 for flashing the match LED indicating lights instead of providing a continuous steady state display each time a match has occurred.

Although the preferred embodiment of the invention has been described in the context of a game, it is clear that it can be employed for therapeutic or rehabilitative work where hand-to-eye coordination is either being tested or improved. Additionally, the utilization of the game complete circuit output from gate 122 can be employed in a variety of other environments. Thus for example, the system could be employed as a lock-out device in an automobile preventing operation of the automobile's ignition system by an inebriated person who is unable to successfully match the scanning display. Also, the system by suitably matrixing the outputs of latch circuit 110 can be utilized as a combination lock, for example, where only certain predetermined scan columns are matched to provide the desired actuating signal for an electrically operated lock. These and other applications and modifications to the present invention will, however, become apparent to those skilled in the art and will fall within the spirit and scope of the present invention as defined by the appended claims.

The embodiments of the invention in which an exclusive property or privilege is claimed are defined as follows:

1. An electronic game comprising:

scanning signal generating means for developing a repetitive series of sequentially occurring pulses;

first display means coupled to said scanning signal generating means for providing a repetitive scanning display;

player actuated switch means;

sequencing circuit means coupled to said switch means for developing sequencing pulses in response to the actuation of said switch means;

second display means coupled to said sequencing circuit means for displaying said sequencing pulses;

coincidence detecting means coupled to said generating means and to said sequencing means for providing an output signal when a pulse of said repetitive series of pulses coincides with a sequencing pulse from said sequencing means; and third display means coupled to said coincidence detecting means for displaying said output signals.

2. The game as defined in claim 1 wherein said generating means comprises a clock frequency generator and first counter means coupled to said clock frequency generator.

3. An electronic game comprising:

scanning signal generating means comprising a clock frequency generator and first counter means coupled to said clock frequency generator for developing a repetitive series of sequentially occurring pulses;

player actuated switch means;

sequencing circuit means coupled to said switch means for developing a sequencing pulse in response to the actuation of said switch means said sequencing circuit means comprising second counter means and differentiator circuit means coupled to said second counter means for differentiating the output signals therefrom; and coincidence detecting means coupled to said generating means and to said sequencing means for providing an output signal when a pulse of said repetitive series of pulses coincides with a sequencing pulse from said sequencing means.

4. The game as defined in claim 3 wherein said coincidence detecting means comprises a plurality of AND gates each having one input terminal coupled to a predetermined output terminal of said first counter means and another input terminal coupled to a predetermined output terminal of said differentiator circuit means.

5. The game as defined in claim 3 and further including display means coupled to said generating means, said sequencing means and said detecting means for providing an output display of the signals therefrom.

6. An electronic game comprising:

scanning signal generating means for developing a repetitive series of sequentially occurring pulses;

player actuated switch means;

sequencing circuit means coupled to said switch means for developing a sequencing pulse in response to the actuation of said switch means;

coincidence detecting means coupled to said generating means and to said sequencing means for providing an output signal when a pulse of said repetitive series of pulses coincides with a sequencing pulse from said sequencing means; and display means coupled to said generating means, said sequencing means and said detecting means for providing an output display of the signals therefrom, wherein said display means comprises an array of light emitting diodes (LEDs) including first, second and third rows of spaced and aligned LEDs, and circuit means coupling a first row of said array to said generating means to provide a scanning display row said circuit means coupling another row of said array to said detecting means to provide a matched display output and said circuit means coupling a third row of said array to said sequencing means to indicate to the operator which position of the third row will be activated when said switch means is actuated.

7. The game as defined in claim 6 wherein said generating means comprises a variable frequency clock pulse generator and first counter means coupled to said clock pulse generator.

8. The game as defined in claim 7 wherein said sequencing circuit means comprises second counter means and differentiator circuit means coupled to said second counter means for differentiating the output signals therefrom.

9. The game as defined in claim 8 wherein said coincidence detecting means comprises a plurality of AND gates each having one input terminal coupled to a predetermined output terminal of said first counter means and another input terminal coupled to a predetermined output terminal of said differentiator circuit means.

10. The game as defined in claim 9 and further including enabling circuit means coupled to said clock pulse generator for enabling said clock pulse generator for an adjustable period of time.

11. The game as defined in claim 10 wherein said enabling circuit means comprises a multiplexing circuit.

12. An electronic game comprising:

a first series of indicator means;

scanning circuit means coupled to said first series of indicator means for providing a repetitive series of pulses applied to said first series of indicator means for successively scanning said first series of indicator means;

a second series of indicator means having indicators aligned with the indicators of said first series of indicator means;

sequencing circuit means coupled to said second series of indicator means and including a player operated switch for providing a pulse output in response to the actuation of said switch, said pulse output applied to said second series of indicator means for actuating a successive one of said indicators in said second series in response to the successive actuation of said switch;

a third series of indicator means having indicators aligned with the indicators of said first and second series of indicator means;

coincidence detecting means coupled to said scanning circuit means and to said sequencing circuit means for developing a matching signal in the event a pulse output from said sequencing circuit means occurs in time coincidence with a pulse of said series of pulses from said scanning circuit means; said matching signal applied to said third series of indicator means for actuating an indicator thereof aligned with indicators actuated in said first and second series.

13. The game as defined in claim 12 wherein said first, second and third series of indicator means each comprises a row of spaced light emitting diodes (LEDs) and wherein said LEDs are vertically aligned.

14. The game as defined in claim 13 wherein said scanning circuit means comprises a clock frequency generator and first counter means coupled to said clock frequency generator.

15. The game as defined in claim 14 wherein said sequencing circuit means comprises second counter means and differentiator circuit means coupled to said second counter means for differentiating the output signals therefrom.

16. The game as defined in claim 15 wherein said coincidence detecting means comprises a plurality of AND gates each having one input terminal coupled to a predetermined output terminal of said first counter means and another input terminal coupled to a predetermined output terminal of said differentiator circuit means.

17. The game as defined in claim 16 and further including bell circuit means coupled to said coincidence detecting means and including a bell, said bell circuit means responsive to a matching signal for ringing said bell.

18. The game as defined in claim 12 and further including a plurality of AND gates coupled to said coincidence detecting means for sequentially enabling said coincidence detecting means to provide matching signals only in a predetermined sequence.

19. An electronic game comprising:

a first series of indicator means;

scanning circuit means coupled to said first series of indicator means for providing a repetitive series of pulses applied to said first indicator means for successively scanning said first series of indicator means;

a second series of indicator means having at least one indicator aligned with an indicator of said first series of indicator means;

sequencing circuit means coupled to said second series of indicator means and including a player operated switch for providing pulse output signals in response to the actuation of said switch, said pulse output signals applied to said second series of indicator means for actuating successive ones of said indicators in said second series in response to the actuation of said switch;

coincidence detecting means coupled to said scanning circuit means and to said sequencing circuit means for developing a matching signal in the event a pulse output from said sequencing circuit means occurs in time coincidence with a pulse of said series of pulses from said scanning circuit means; and third indicator means coupled to said coincidence detecting means for providing an output indication when a matching signal is developed.

* * * * *